US011667466B2

(12) United States Patent
Jansen et al.

(10) Patent No.: US 11,667,466 B2
(45) Date of Patent: Jun. 6, 2023

(54) EASY-EMPTY FLEXIBLE INTERMEDIATE BULK CONTAINER DEVICES, SYSTEMS, AND METHODS FOR USE WITH BULK GARDEN PRODUCTS

(71) Applicant: THE GREENHORIZONS GROUP OF FARMS LTD., Mount Hope (CA)

(72) Inventors: Fraser Jansen, Ancaster (CA); Peter Rauwerda, Hamilton (CA); Steven Schiedel, Mount Hope (CA)

(73) Assignee: THE GREENHORIZONS GROUP OF FARMS LTD., Mount Hope (CA)

( * ) Notice: Subject to any disclaimer, the term of this patent is extended or adjusted under 35 U.S.C. 154(b) by 0 days.

(21) Appl. No.: 17/154,822

(22) Filed: Jan. 21, 2021

(65) Prior Publication Data

US 2021/0221604 A1 Jul. 22, 2021

Related U.S. Application Data

(60) Provisional application No. 62/963,870, filed on Jan. 21, 2020.

(51) Int. Cl.
*B65D 88/16* (2006.01)

(52) U.S. Cl.
CPC ..... *B65D 88/1668* (2013.01); *B65D 88/1687* (2013.01); *B65D 2588/167* (2013.01)

(58) Field of Classification Search
CPC ..... B65D 2588/16; B65D 2588/162; B65D 2588/165; B65D 2588/167; B65D 88/005; B65D 88/16; B65D 88/1606; B65D 88/1612; B65D 88/1618; B65D 88/1625; B65D 88/1631; B65D 88/1637; B65D 88/1643; B65D 88/165; B65D 88/1656; B65D 88/1662; B65D 88/1668; B65D 88/1675; B65D 88/1681; B65D 88/1687;
(Continued)

(56) References Cited

U.S. PATENT DOCUMENTS 5,078,096 A * 1/1992 Bishop ..... E04H 15/40 119/497
2012/0193354 A1* 8/2012 Cavenagh ..... B65D 88/1612 220/9.3

FOREIGN PATENT DOCUMENTS

JP 2004256139 A * 9/2004

OTHER PUBLICATIONS

JP2004256139ATranslation (Year: 2004).*

* cited by examiner

*Primary Examiner* — Jes F Pascua
*Assistant Examiner* — Nina K Attel
(74) *Attorney, Agent, or Firm* — Holbeche Law; Kevin Edward Holbeche

(57) ABSTRACT

A container includes a robust semi-rigid main bag, a tarpaulin top section, and ties on the main bag. The main bag has a base and side panels for containing bulk garden products. The top section engages an upper portion of the main bag and has an opening. When open, it enables access into the main bag. When selectively closed, the top section protects the bulk garden products against outside elements. The ties can selectively tie down the top section and enable clear and ready access into the main bag containing the bulk garden products. Ties located about midway down the main bag, after it has been emptied of about half the bulk garden products, can also selectively tie down the upper portion for continued clear and ready access to any bulk garden products that then remain in the main bag.

12 Claims, 12 Drawing Sheets

(58) Field of Classification Search
CPC .... B65D 88/1693; B65D 88/18; B65D 88/20; B65D 88/22; B65D 88/24
USPC ..... 383/2, 4, 33, 42, 71–77, 6; 220/495.11, 220/495.08; 224/655
See application file for complete search history.

EASY-EMPTY FLEXIBLE INTERMEDIATE BULK CONTAINER DEVICES, SYSTEMS, AND METHODS FOR USE WITH BULK GARDEN PRODUCTS

FIELD OF THE INVENTION

The present invention relates generally to flexible containers (alternately herein, "flexible intermediate bulk containers", "FIBCs", or "bags") for use with bulk garden products and, more particularly, to easy-empty flexible containers, systems, and/or methods for use with bulk garden products.

BACKGROUND OF THE INVENTION

In the prior art, FIBCs may have been adapted to contain about 1 cubic yard of bulk garden products (e.g., soil). They may have been designed with a multi-material construction and/or provided with an open tarpaulin top. Prior art open tarpaulin bag tops may have been adapted to be rolled down. Users may have shoveled bulk garden products out of prior art flexible intermediate bulk containers without any additional ways to secure their open tarpaulin tops besides rolling them down. In the prior art, rolling down such open tarpaulin bag tops often may have proved ineffective. Perhaps due to the multi-material construction of these bags, rolling may have been somewhat difficult—especially, for example, when a user may have tried to roll the bag down past and/or beyond its tarpaulin top section. Prior art FIBC bags may have needed to be robust in order to withstand immense loads during delivery, so their side panels may have been constructed from somewhat rigid materials which may have likewise made it difficult to roll such bags down without additional tools to secure them. Users may have often struggled while trying to access the bulk garden products, since the tarpaulin top section may not have been secured. Wind may have blown it around, and/or shorter, less-abled users may have had great difficulty trying to access the bulk garden products inside.

Prior art bags may have been made of two main materials. First, side panels and the base of the bag, where the soil generally sits inside, may have been constructed of a first material. Secondly, a tarpaulin top may have been used to close the bag and protect the products inside the bag from the elements (e.g., wind, rain, snow). The tarpaulin top often may have hindered a user's ability to access the bag's contents. Once the bag was partly emptied, the side panels also may have posed a further obstacle, when users tried to access the bag's contents. One or more of these factors may have made it cumbersome and/or difficult for many users to empty prior art bags.

Additionally, prior art FIBCs may have suffered insofar as their size and shape may have been less than optimal for maximizing how many such FIBCs, and the cubic yards of bulk garden products, can fit onto a single flatbed truck for delivery to users. For example, the width of a flatbed truck may have fit only two (2) prior art FIBCs, with each containing about 1 cubic yard of bulk garden products.

It may be an object according to one aspect of the invention to provide an FIBC that maximizes how many such FIBCs, and how many cubic yards of bulk garden products, can fit onto a single flatbed truck for delivery to users. For example, it may be an object according to one aspect of the invention to provide FIBCs, each sized, shaped and otherwise adapted to contain about 1 cubic yard of bulk garden products and such that three (3) such FIBCs can together fit across the width of a flatbed truck.

It may be an object according to one aspect of the invention to provide easy-empty flexible intermediate bulk container devices, systems, and/or methods for use with bulk garden products.

It may be an object according to one aspect of the invention to provide a device, system, and/or method for expediting and/or simplifying removal of bulk garden products from flexible intermediate bulk bags (e.g., the BigYellowBag™ containers offered by the applicant).

It may be an object according to one aspect of the invention to provide a device, system, and/or method which enables users to secure a loose, open duffel top of a flexible intermediate bulk container, and/or to move or keep the bag's duffel top out of the way, while emptying the container.

It is an object of the present invention to obviate or mitigate one or more disadvantages and/or shortcomings associated with the prior art, to meet or provide for one or more needs and/or advantages, and/or to achieve one or more objects of the invention—one or more of which may preferably be readily appreciable by and/or suggested to those skilled in the art in view of the teachings and/or disclosures hereof.

SUMMARY OF THE INVENTION

According to the invention, there is disclosed a flexible container for containing bulk garden products (e.g., soil, mulch). The flexible container may preferably include a main bag section, an elongate top section, and two or more sets of bag tie members. The main bag section may preferably be constructed from a robust semi-rigid material. The main bag section may preferably have a base and one or more side portions that securely engage the base. Each of the side portions may preferably have an upper portion. The base and the side portions may preferably be together shaped to define an inside portion for containing the bulk garden products. The side portions may preferably define at least one outside wall. The elongate top section may preferably be constructed from a tarpaulin material. The elongate top section may preferably securely engage the upper portion of the main bag section. The elongate top section may preferably be shaped to define an opening. The elongate top section may preferably be adapted to be selectively moved between (i) an open configuration that may preferably enable access through the opening into the inside portion of the main bag section, and (ii) a closed configuration that may preferably block the opening and protects the bulk garden products in the inside portion of the main bag section against outside elements (e.g., wind, rain, snow). The sets of bag tie members may preferably securely engage the main bag section. Each of the sets may preferably be spaced apart from each other about the side portions of the main bag section. The sets of the aforesaid bag tie members may preferably be adapted to selectively gather and tie down the elongate top section in the open configuration and, preferably thus, to enable clear and ready access into the inside portion of the main bag section containing the bulk garden products.

According to an aspect of one preferred embodiment, each of the sets of the aforesaid bag tie members may preferably, but need not necessarily, include an outer tie member and/or a corresponding inner tie member adapted to be selectively and/or securely tied to said outer tie member. The outer tie member may preferably, but need not necessarily, be secured to the outside wall. The corresponding inner tie member may preferably, but need not necessarily, be secured to the inside portion of the main bag section.

According to an aspect of one preferred embodiment, the outer tie member may preferably, but need not necessarily, include a corresponding loop member. The corresponding inner tie member may preferably, but need not necessarily, include a bag cord member. Each aforesaid bag cord member may preferably, but need not necessarily, be adapted to be selectively and/or securely tied to the aforesaid corresponding loop member.

According to an aspect of one preferred embodiment, each of the side portions may preferably, but need not necessarily, have a middle portion that is located about midway between the upper portion and the base. The sets of the aforesaid bag tie members may preferably, but need not necessarily, include: (a) two or more top sets of the aforesaid bag tie members; and/or (b) two or more middle sets of the aforesaid bag tie members. The top sets of the aforesaid bag tie members may preferably, but need not necessarily, securely engage the upper portion of the main bag section. The top sets of the aforesaid bag tie members may preferably, but need not necessarily, be adapted to selectively gather and/or tie down the elongate top section as aforesaid. The middle sets of the aforesaid bag tie members may preferably, but need not necessarily, securely engage the middle portion of the main bag section. The middle sets of the aforesaid bag tie members may preferably, but need not necessarily, be adapted to, preferably after about half of the bulk garden products may have been emptied from the main bag section, selectively gather and/or tie down the elongate top section as aforesaid and/or, additionally or instead, selectively gather and/or tie down the upper portion of the main bag section, preferably when the elongate top section is in the open configuration and, preferably thus, to enable continued clear and/or ready access to any of the aforesaid bulk garden products that may then remain in the inside portion of the main bag section.

According to an aspect of one preferred embodiment, the side portions may preferably, but need not necessarily, include four side panels. The four side panels may preferably, but need not necessarily, define four corners, preferably one each between adjacent ones of the four side panels. As such, the inside portion may preferably, but need not necessarily, be substantially rectangular. The flexible container may preferably, but need not necessarily, include at least four of the aforesaid sets of the aforesaid bag tie members.

According to an aspect of one preferred embodiment, at least one of the aforesaid sets of the aforesaid bag tie members may preferably, but need not necessarily, securely engage the main bag section adjacent to each of the aforesaid four corners.

According to an aspect of one preferred embodiment, the elongate top section may preferably, but need not necessarily, be provided with one or more top tie members to selectively secure the elongate top section in the closed configuration.

According to an aspect of one preferred embodiment, the top tie members may preferably, but need not necessarily, include a top loop member and a top cord member that may preferably, but need not necessarily, be adapted to be selectively and/or securely tied to the top loop member to secure the elongate top section in the closed configuration.

According to an aspect of one preferred embodiment, the flexible container may preferably, but need not necessarily, be adapted to contain about one cubic yard of the bulk garden products.

According to an aspect of one preferred embodiment, the outside wall may preferably, but need not necessarily, present advertising media.

According to an aspect of one preferred embodiment, the flexible container may preferably, but need not necessarily, be adapted for use with a flatbed truck and/or with forks of a forklift. The flexible container may preferably, but need not necessarily, also include two or more lifting hoops that securely engage the main bag section. The lifting hoops may preferably, but need not necessarily, be such that the flexible container containing the bulk garden products may be selectively carried and/or suspended, preferably by the lifting hoops, on the forks of the forklift while being loaded onto and/or off from the flatbed truck.

According to an aspect of one preferred embodiment, the flexible container may preferably, but need not necessarily, be adapted for use with a flatbed truck. The flexible container may preferably, but need not necessarily, be sized and/or shaped to contain about one cubic yard of the bulk garden products. The flexible container may preferably, but need not necessarily, be sized and/or shaped such that three of said flexible containers may preferably together fit across the width of the flatbed truck.

According to the invention, there is also disclosed an easy-empty flexible intermediate bulk container device, system, and/or method for use with bulk garden products (e.g., soil).

According to an aspect of one preferred embodiment, the device, system, and/or method may preferably be adapted for use together with and/or as part of a flexible intermediate bulk container ("FIBC" or "bag"). The FIBC may preferably have a main section that includes side panels and a base, each constructed of a robust and/or semi-rigid material, and together adapted to contain about 1 cubic yard of the bulk garden products. The bag may preferably have a tarpaulin top section adapted to selectively close the FIBC and protect the bulk garden products inside against outside elements (e.g., wind, rain, snow). The top section may preferably, but need not necessarily, be provided with a top tie member to selectively close the tarpaulin top section. According to the invention, the device, system, and/or method may preferably enable users to tie down the top section of the bag at each corner, thus preferably enabling increased and/or better access into the main section of the FIBC containing the bulk garden products.

According to an aspect of one preferred embodiment, the device, system, and/or method preferably implements one or more main section ties (e.g., similar in nature to the top tie member) and corresponding loops secured to an inside and an outside of the main section. Preferably, but not necessarily, the ties may be secured to the inside, and the loops may be secured to the outside, of the main section. Preferably, but not necessarily, one of the ties and a corresponding one of the loops may be secured adjacent to each corner of the main section. Preferably, but not necessarily, the device, system, and/or method preferably implements a top set of the ties and the corresponding loops which may be provided adjacent a top portion of the main section (i.e., below the tarpaulin top section), and/or a secondary/middle set of the ties and the corresponding loops which may be provided about half-way down the bag, adjacent to a middle portion of the main section (i.e., below the top set). The top set of the ties and the corresponding loops may preferably enable and/or facilitate the tarpaulin top section of the bag to be tucked and/or rolled down, and securely tied out of the way, by a user when accessing the bulk garden products inside the main section of the FIBC. The secondary/middle set of the ties and the corresponding loops may preferably enable and/or facilitate the tarpaulin top section to be tucked and/or rolled down, and securely tied out of the way, by the user after the bag has been partially emptied.

Other advantages, features and characteristics of the present invention, as well as methods of operation and functions of the related elements of the structure, and the combination of parts and economies of manufacture, will become more apparent upon consideration of the following detailed description with reference to the following figures which accompany this application.

BRIEF DESCRIPTION OF THE DRAWINGS

The novel features which are believed to be characteristic of the present invention, and related devices, systems, and methods according to the present invention, as to their structure, organization, use and method of operation, together with further objectives and advantages thereof, may be better understood from the figures which accompany this application, in which a presently preferred embodiment of the invention is illustrated by way of example. It is expressly understood, however, that such figures are for the purpose of illustration and description only, and not intended as a definition of the limits of the invention. In the accompanying drawings.

DETAILED DESCRIPTION OF PREFERRED EMBODIMENTS

Figure 1A:
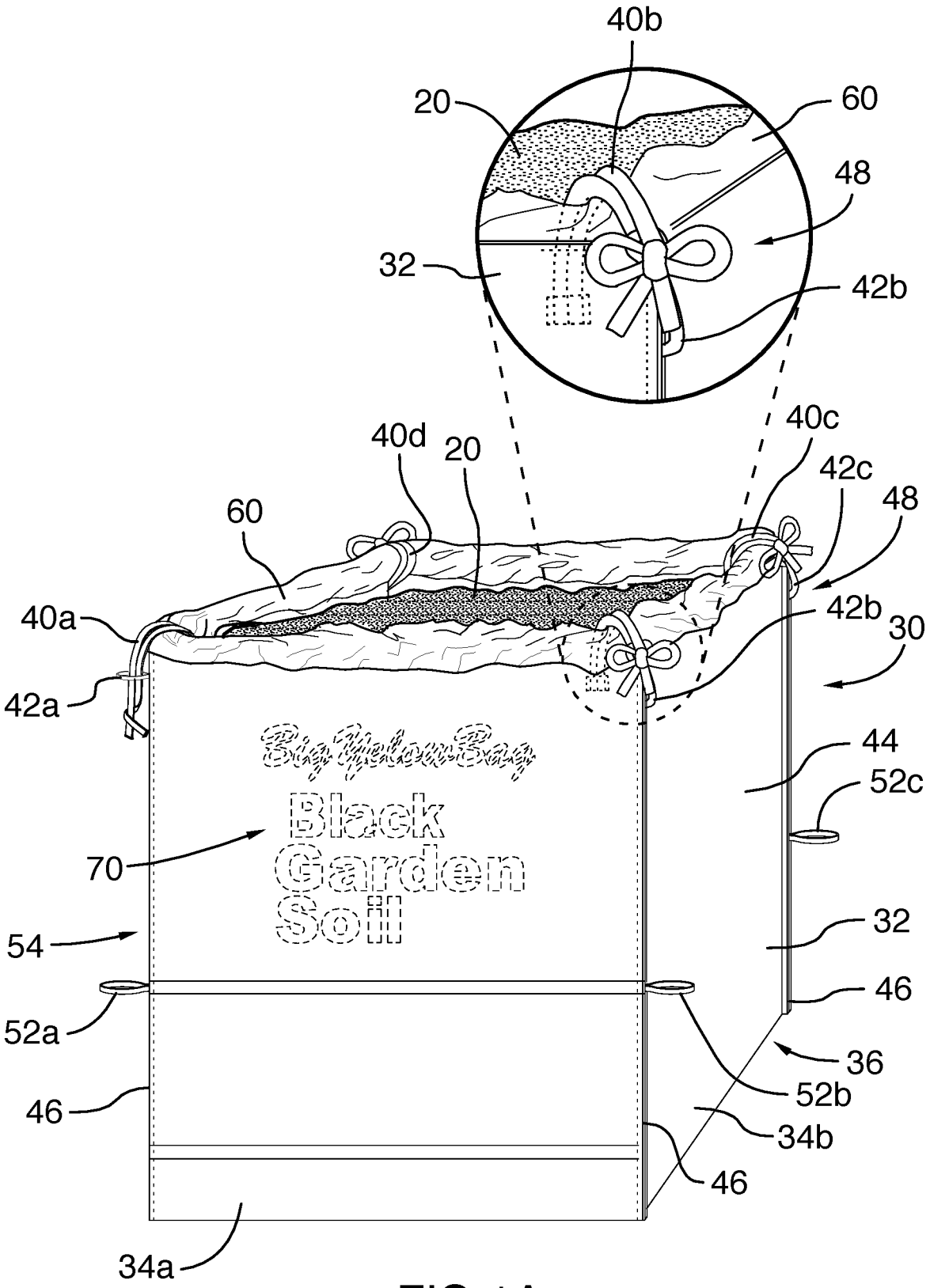
FIG. 1A is a top front left perspective view of a flexible container according to a preferred embodiment of the invention, showing a main bag section and an elongate top section thereof, and shown in an open configuration with bulk garden products.

This disclosure, including the accompanying drawings, may include text, instructions, and/or dimensions and/or depictions of the invention which may or may not be drawn to scale and, in any event, are provided by way of example. It may bear repeating, in this respect specifically, that such drawings and/or disclosures are for the purpose of illustration and description only, and not intended as a definition of the limits of the invention.

Additionally, one or more of the directional terms (e.g., front, top, bottom, middle, upper, lower, left, right, side) or other terms used herein, and in the accompanying drawings, may be otherwise regarded and/or referenced using other terms.

FIGS. 1 to 8 depict a flexible container 30 for containing about one cubic yard of bulk garden products (e.g., soil, mulch) 20 according to a preferred embodiment of the invention. The flexible container 30 includes a main bag section 32 and an elongate top section 60.

The main bag section 32 is constructed from a robust semi-rigid material. The main bag section 32 preferably has a base 36 and four side panels 34*a*, 34*b*, 34*c*, 34*d* that securely engage the base 36. The side panels 34*a*, 34*b*, 34*c*, 34*d* define four corners 46—one each between adjacent ones of the side panels 34*a*, 34*b*, 34*c*, 34*d*. Each of the side panels 34*a*, 34*b*, 34*c*, 34*d* has an upper portion 48 and a middle portion 54 that is located about midway between the upper portion 48 and the base 36.

The base 36 and the side panels 34*a*, 34*b*, 34*c*, 34*d* are together shaped to define an inside portion 38 for containing the bulk garden products 20. Preferably, the inside portion 38 is substantially rectangular.

Preferably, each of the side panels 34*a*, 34*b*, 34*c*, 34*d* defines an outside wall 44. The outside wall 44 may preferably present advertising media 70, such as, for example, the applicant's BigYellowBag trademark.

Figure 3:
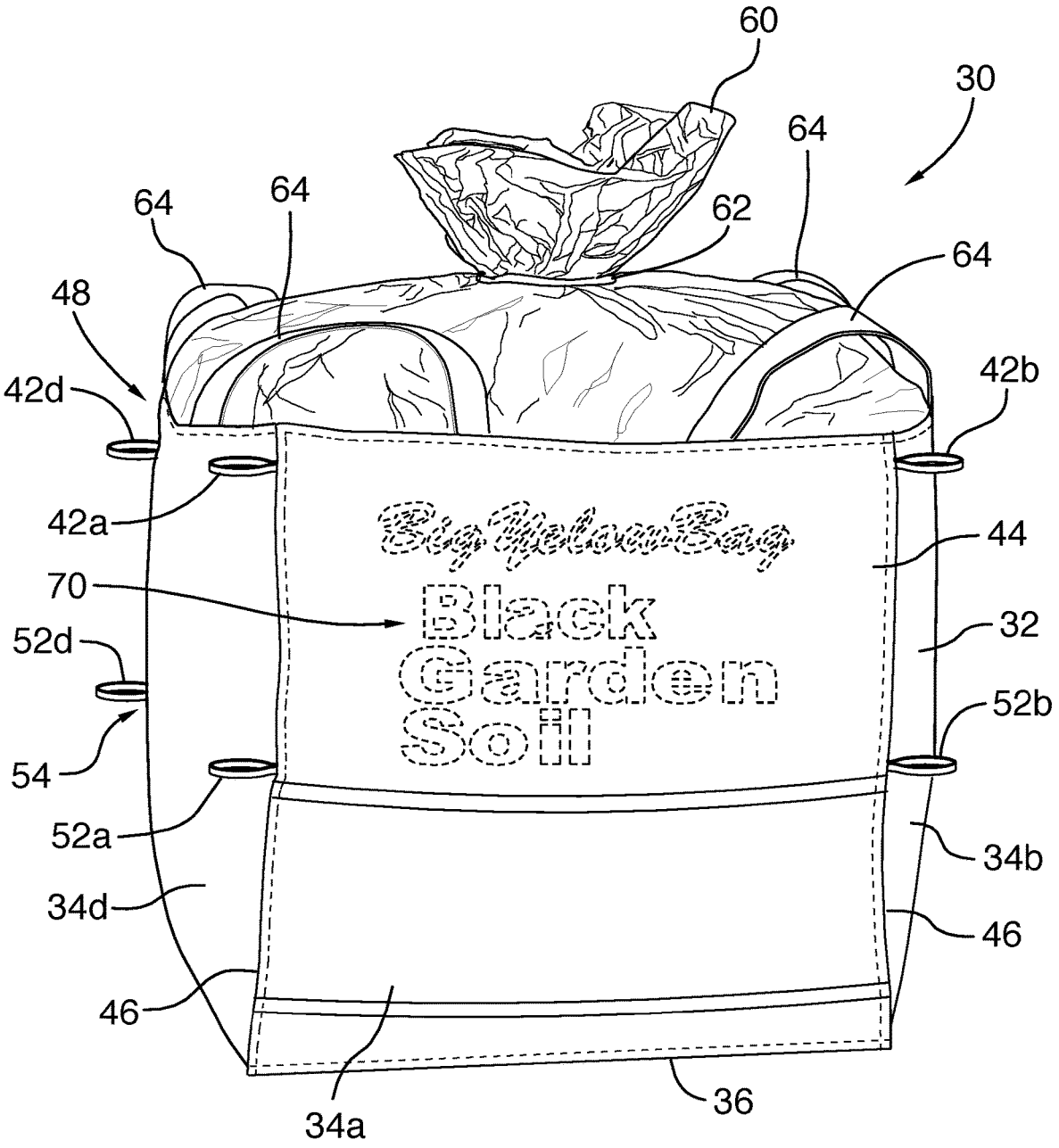
FIG. 3 is a top front perspective view of the flexible container of FIG. 1A, shown in a closed configuration.
Figure 5:
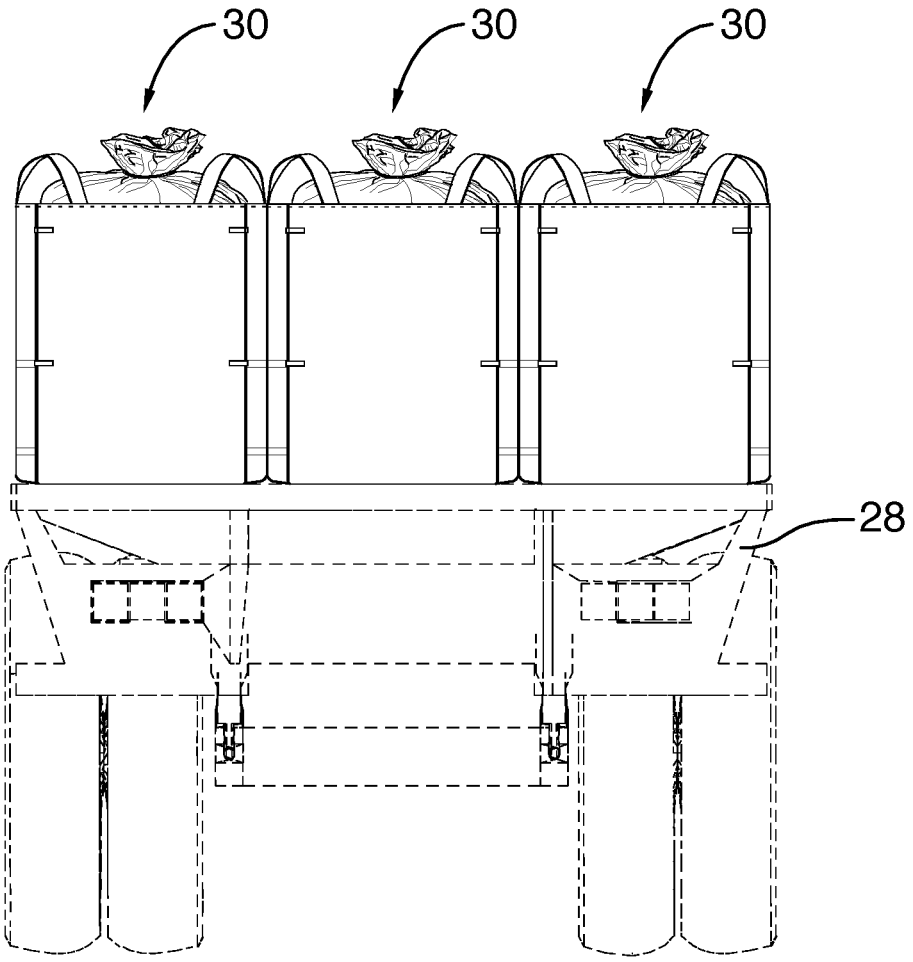
FIG. 5 is a left side elevational view of three of the flexible containers of FIG. 3, shown loaded onto a flatbed truck.
Figure 6:
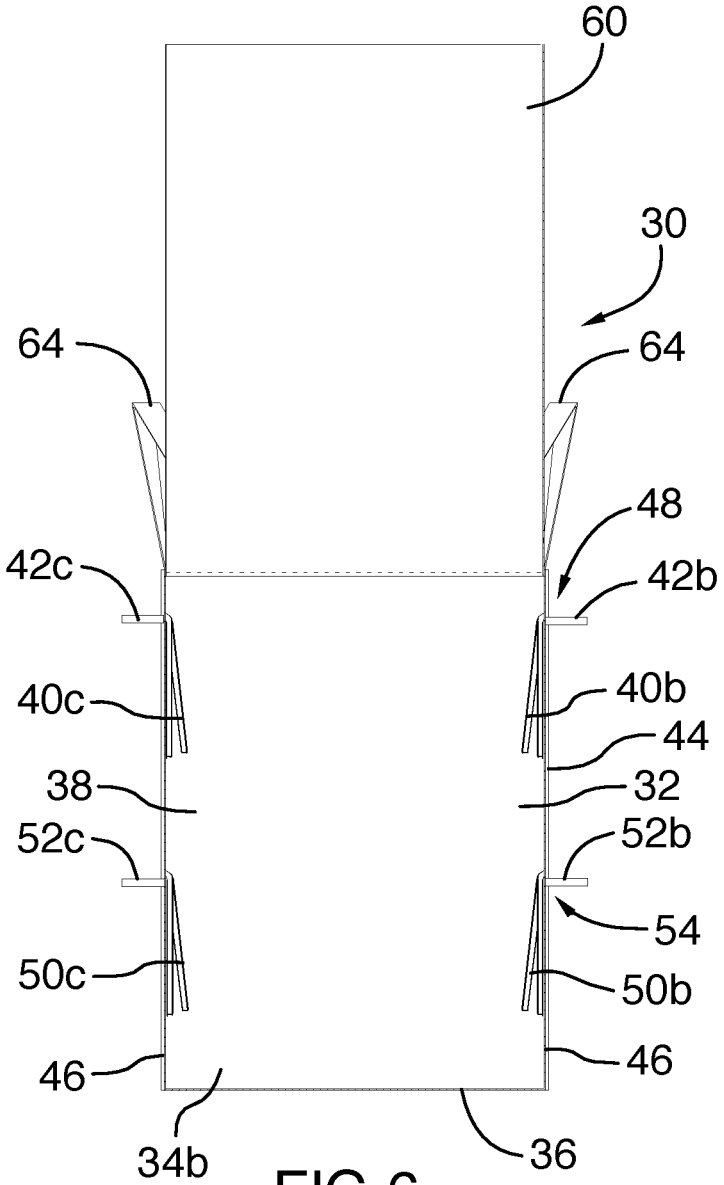
FIG. 6 is a right side partially section view of the flexible container of FIG. 2C, along sight line 6-6.
Figure 7:
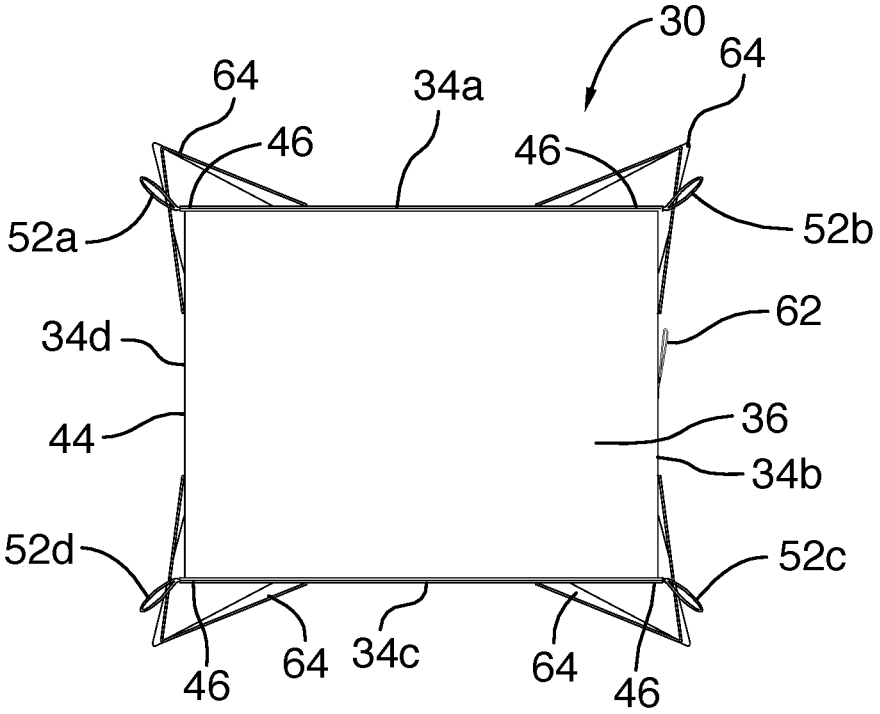
FIG. 7 is a bottom plan view of the flexible container of FIG. 2C.
Figure 8:
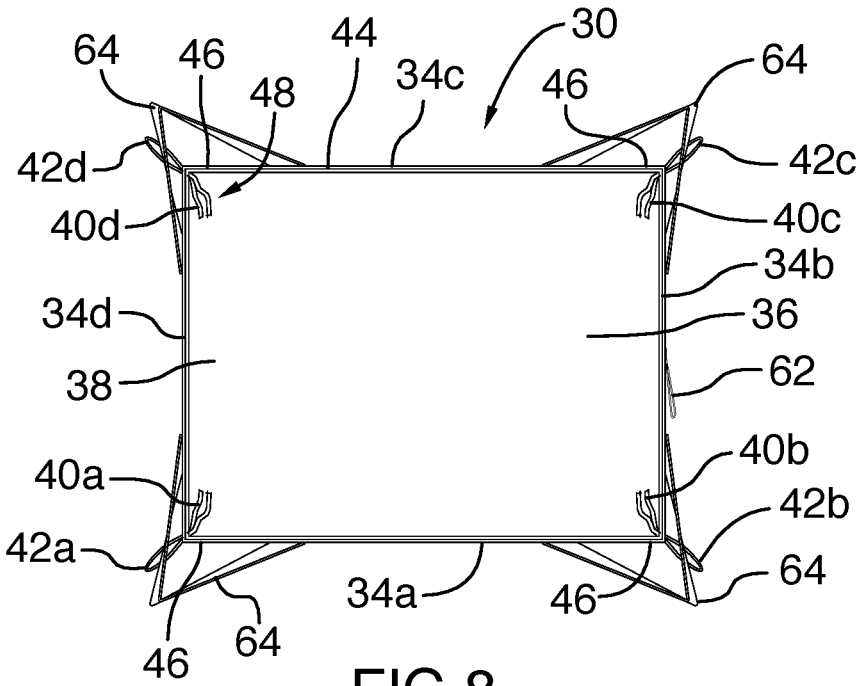
FIG. 8 is a top plan view of the flexible container of FIG. 2C.

The elongate top section (or tarpaulin top section) 60 is constructed from a tarpaulin material. The elongate top section 60 securely engages the upper portion 48 of the main bag section 32. The elongate top section 60 is shaped to define an opening, as best seen in FIGS. 1A, 1B, 4A, and 8. The elongate top section 60 is adapted to be selectively moved between an open configuration (as shown in FIGS. 1A, 1B, 4A, and 8) and a closed configuration (as shown in FIGS. 3 and 5). As shown in FIGS. 1A, 1B, 4A, and 8, the open configuration enables access through the opening into the inside portion 38 of the main bag section 32. As shown in FIGS. 3 and 5, the closed configuration blocks the opening and protects the bulk garden products 20 in the inside portion 38 of the main bag section 32 against outside elements (e.g., wind, rain, snow).

Preferably, the flexible container 30 also has eight sets of bag tie members 40*a*,42*a*, 40*b*,42*b*, 40*c*,42*c*, 40*d*,42*d*, 50*a*, 52*a*, 50*b*,52*b*, 50*c*,52*c*, 50*d*,52*d* securely engaging the main bag section 32.

Preferably each set includes a bag cord member (or inner tie member) 40*a*, 40*b*, 40*c*, 40*d*, 50*a*, 50*b*, 50*c*, 50*d* that is secured to the inside portion 38 of the main bag section 32, and a corresponding loop member (or outer tie member) 42*a*, 42*b*, 42*c*, 42*d*, 52*a*, 52*b*, 52*c*, 52*d* that is secured to the outside wall 44. In each set—i.e., in set 40*a*,42*a*, in set 40*b*,42*b*, in set 40*c*,42*c*, in set 40*d*,42*d*, in set 50*a*,52*a*, in set 50*b*,52*b*, in set 50*c*,52*c*, and in set 50*d*,52*d*—the bag cord member 40*a*, 40*b*, 40*c*, 40*d*, 50*a*, 50*b*, 50*c*, 50*d* is adapted to be selectively and securely tied to its corresponding loop member 42*a*, 42*b*, 42*c*, 42*d*, 52*a*, 52*b*, 52*c*, 52*d*.

The sets include four top sets (i.e., set 40*a*,42*a*, set 40*b*,42*b*, set 40*c*,42*c*, and set 40*d*,42*d*) that securely engage the upper portion 48, and four middle sets (i.e., set 50*a*,52*a*, set 50*b*,52*b*, set 50*c*,52*c*, and set 50*d*,52*d*) that securely engage the middle portion 54 of the main bag section 32.

The sets are spaced apart from each other, with two of the sets securely engaging the main bag section 32 adjacent to each of the aforesaid four corners 46. That is, top set 40*a*,42*a* and middle set 50*a*,52*a* are adjacent to a first corner 46, top set 40*b*,42*b* and middle set 50*b*,52*b* are adjacent to a second corner 46, top set 40*c*,42*c* and middle set 50*c*,52*c* are adjacent to a third corner 46, and top set 40*d*,42*d* and middle set 50*d*,52*d* are adjacent to the last corner 46.

The top sets (i.e., set 40*a*,42*a*, set 40*b*,42*b*, set 40*c*,42*c*, and set 40*d*,42*d*) are adapted to selectively gather and tie down the elongate top section 60 in the open configuration, as best seen in FIG. 1A. In this manner, the aforesaid top sets enable clear and ready access into the inside portion 38 of the main bag section 32 containing the bulk garden products 20.

Figure 1B:
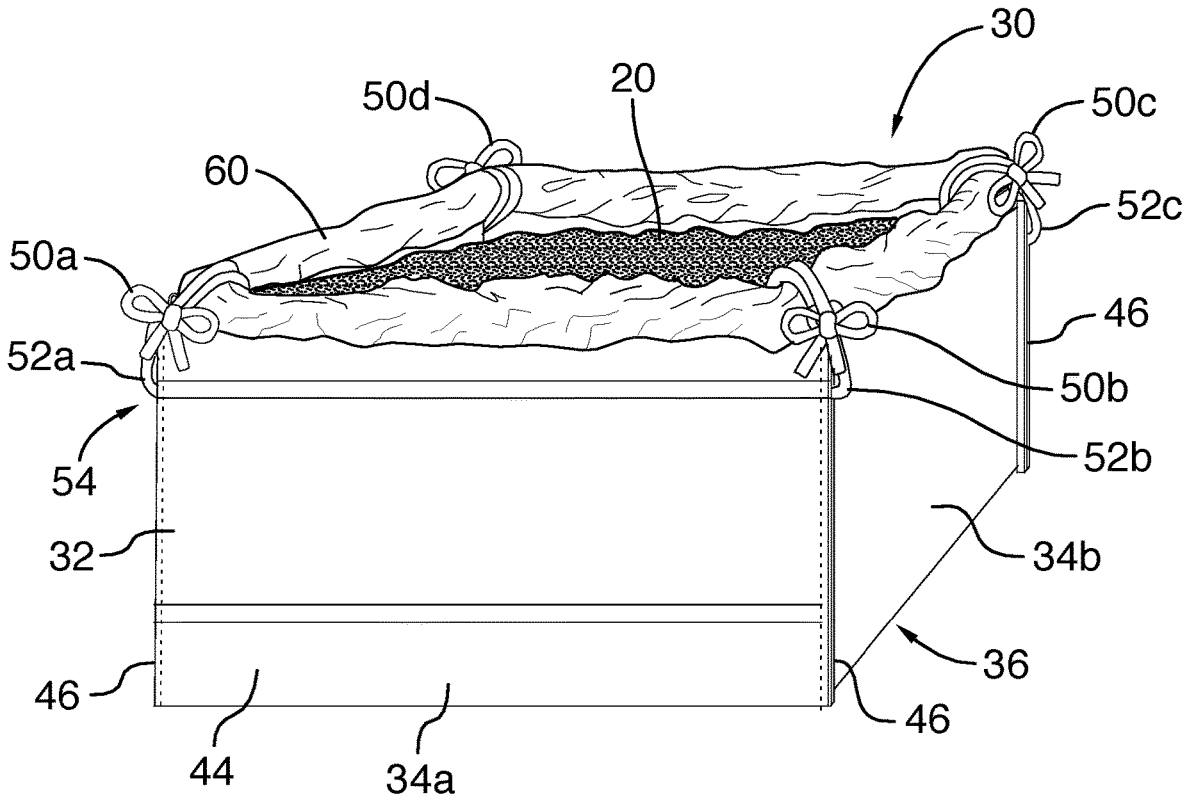
FIG. 1B is a top front left perspective view of the flexible container of FIG. 1A, shown in an open folded down configuration with bulk garden products.
Figure 2A:
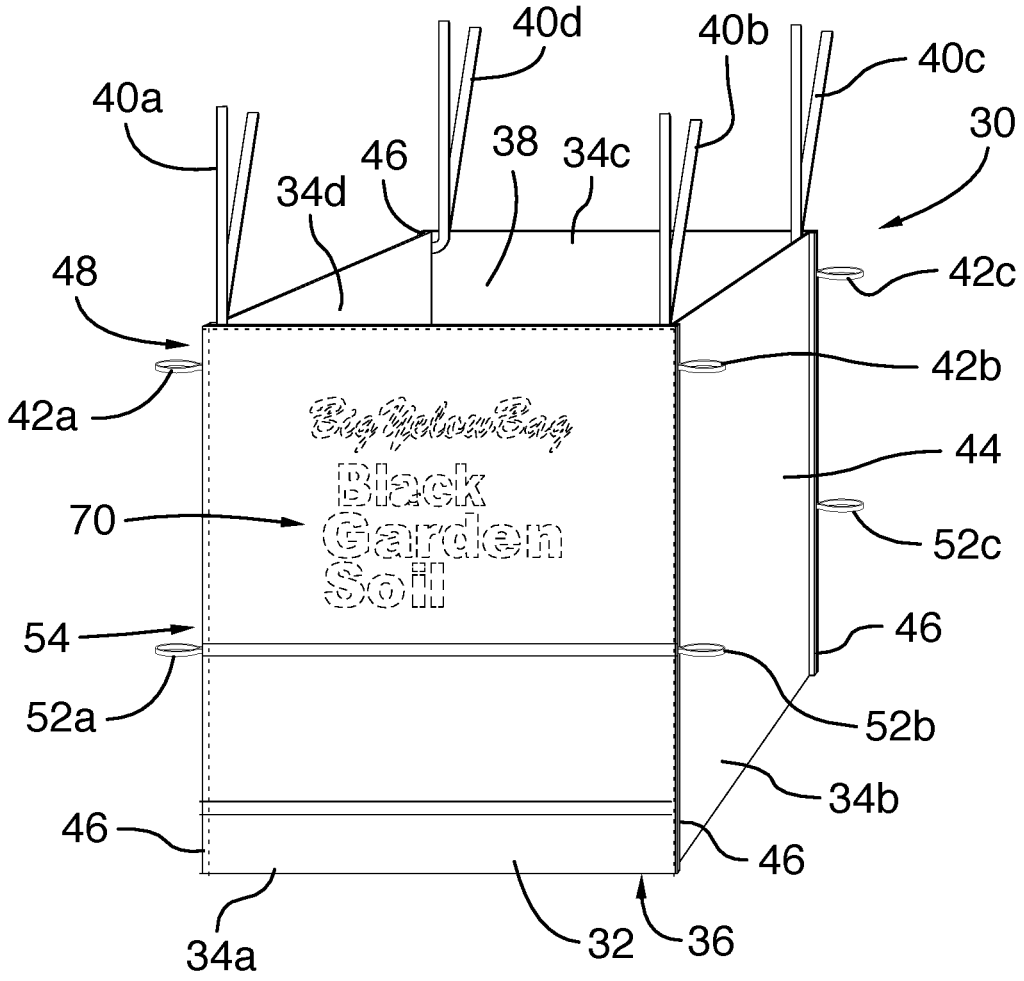
FIG. 2A is a top front left perspective view of the main bag section shown in FIG. 1A, shown empty in the open configuration.
Figure 2B:
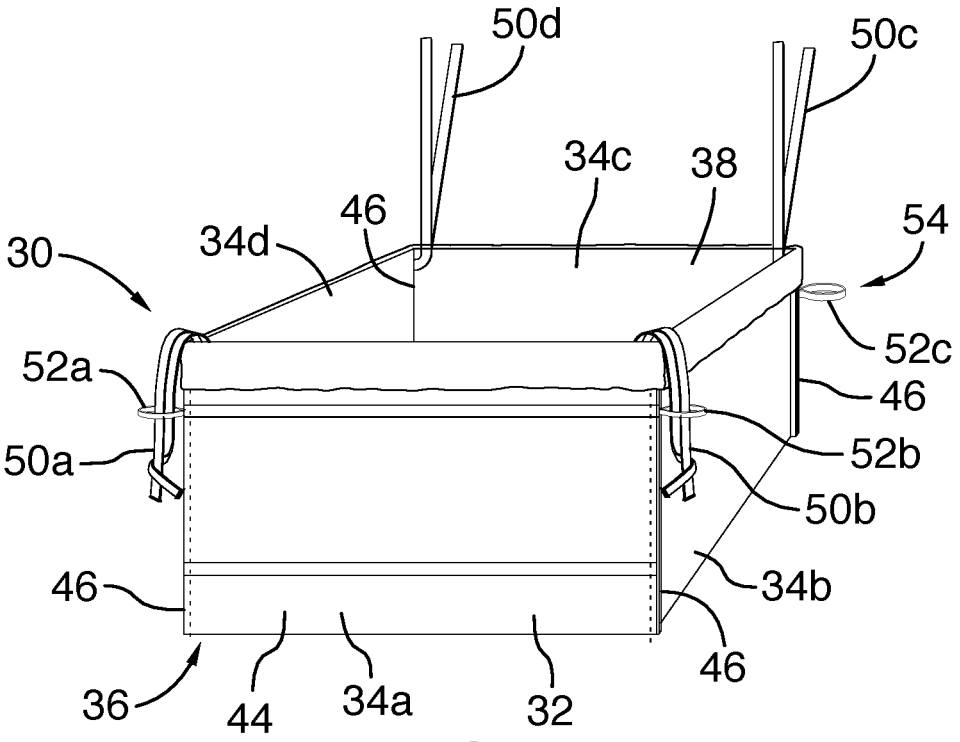
FIG. 2B is a top front left perspective view of the flexible container of FIG. 1A, shown empty in the open folded down configuration.
Figure 2C:
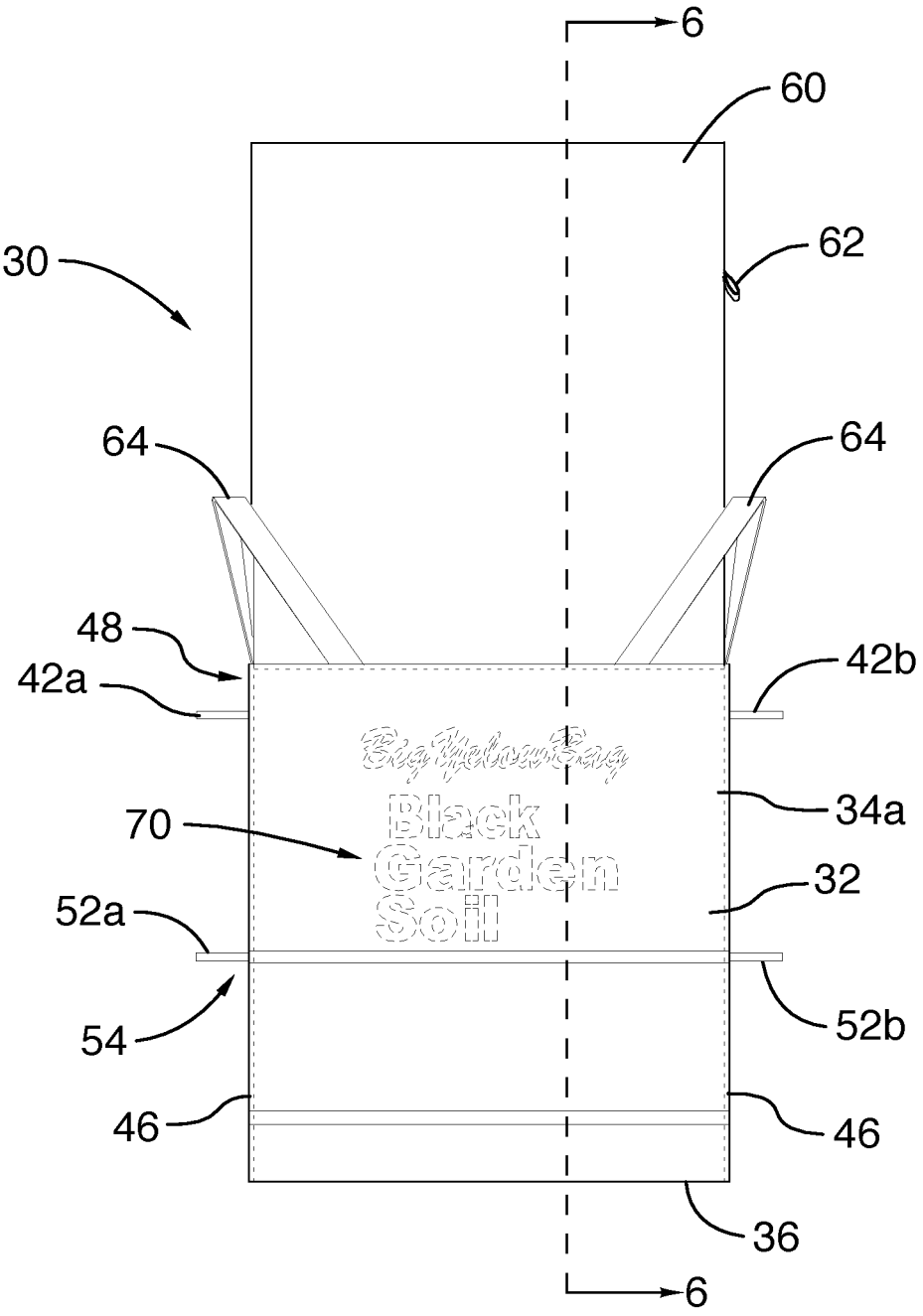
FIG. 2C is a front elevational view of the flexible container of FIG. 1A, shown with the elongate top section in an extended configuration.
Figure 4A:
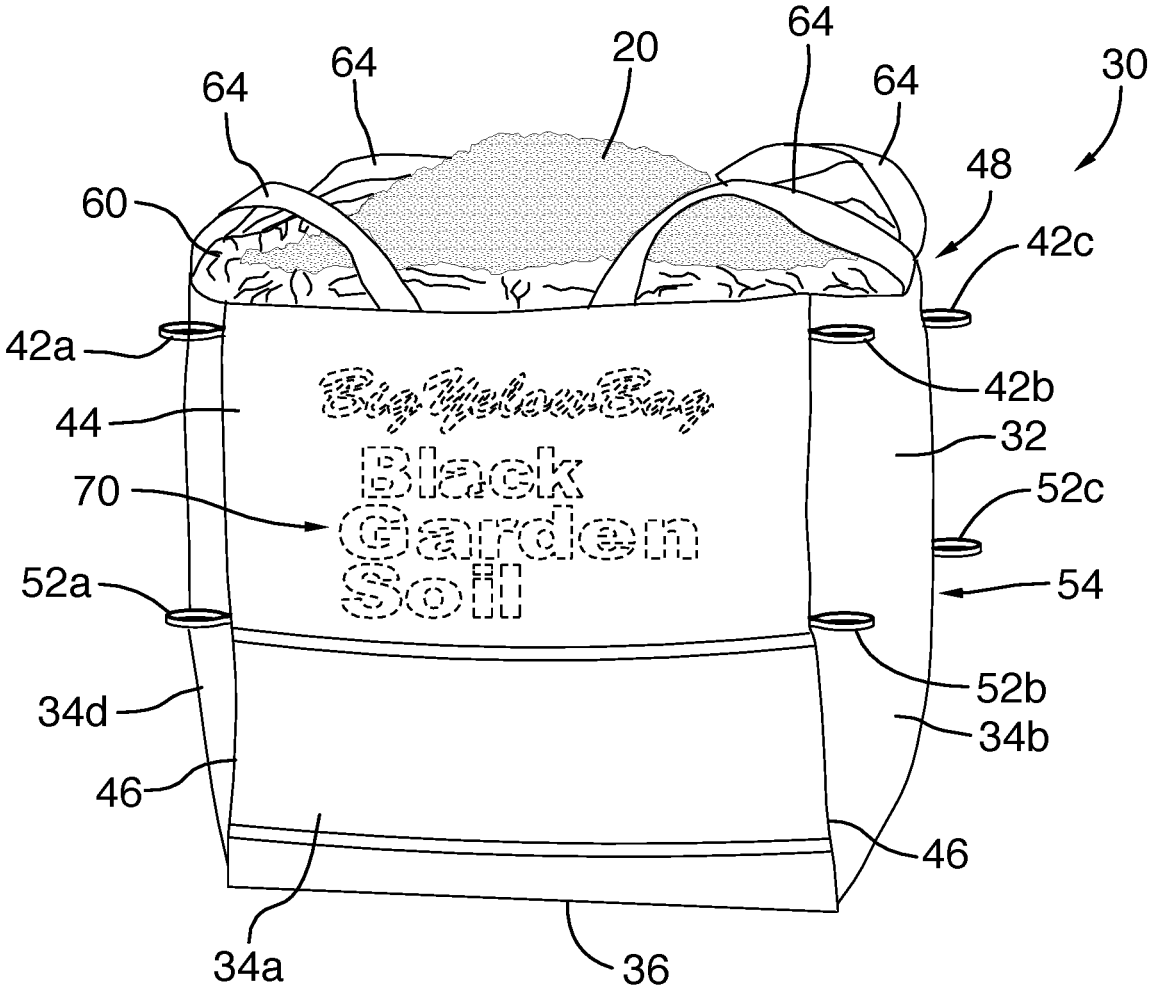
FIG. 4A is a top front perspective view of the flexible container of FIG. 1A, shown in another open configuration with bulk garden products.
Figure 4B:
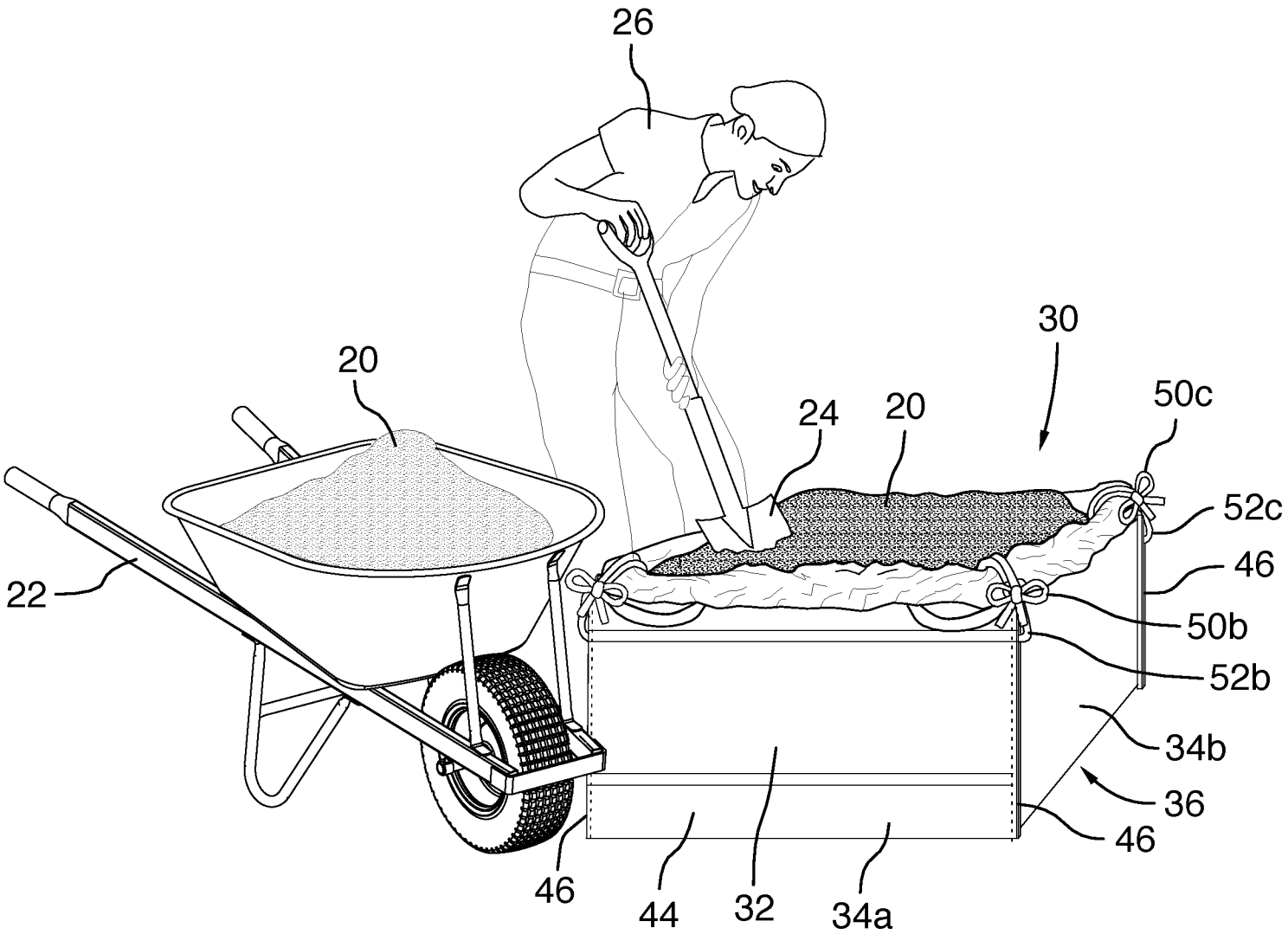
FIG. 4B is a top front left perspective view of the flexible container of FIG. 1B, shown in in use.

As may be best appreciated from FIGS. 1B, 2B, and 4B, the middle sets (i.e., set 50*a*,52*a*, set 50*b*,52*b*, set 50*c*,52*c*, and set 50*d*,52*d*) are adapted to, after about half of the bulk garden products have been emptied from the main bag section 32, selectively gather and tie down the elongate top section 60 as aforesaid and, also, selectively gather and tie down the upper portion 48 of the main bag section 32 when the elongate top section 60 is in the open configuration. In this manner, the aforesaid middle sets enable continued clear and ready access to any of the aforesaid bulk garden products 20 that then remain in the inside portion 38 of the main bag section 32.

Figure 2D:
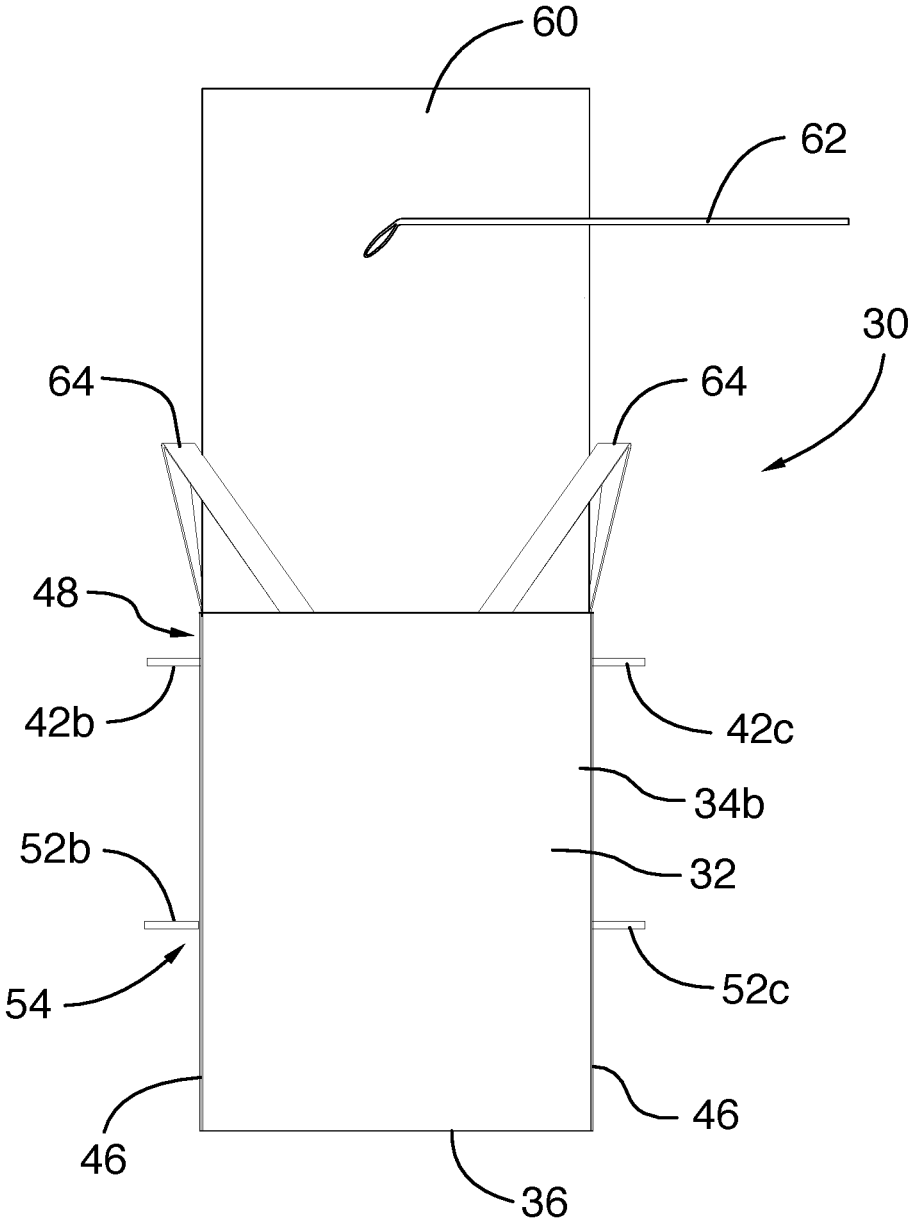
FIG. 2D is a left side elevational view of the flexible container of FIG. 2C.

As may be best appreciated from FIGS. 2D and 3, the elongate top section 60 has a top tie member 62 (including a top loop and a top cord that is adapted to be selectively and securely tied to the top loop) to selectively secure the elongate top section 60 in the closed configuration.

As shown in FIG. 5, the flexible container 30 is adapted for use with a flatbed truck 28. The flexible container 30 is sized and shaped to contain about one cubic yard of the bulk garden products (as aforesaid). The flexible container 30 is sized and shaped such that three of said flexible containers 30, 30, 30 can together fit across the width of the flatbed truck 28 as shown in FIG. 5.

The flexible container 30 also preferably has four lifting hoops 64 that securely engage the main bag section 32. The lifting hoops 64 are such that the flexible container 30 containing the bulk garden products 20 can be selectively carried and suspended, by the lifting hoops 64, on the forks of the forklift while being loaded onto and off from the flatbed truck 28.

As shown in FIGS. 1A to 3, the flexible container (or easy empty flexible intermediate bulk container or "FIBC" device) 30 is preferably for use with the bulk garden products (e.g., soil) 20. The FIBC device 30 preferably includes the main bag section 32 and the tarpaulin top section 60.

The main bag section 32 preferably includes the four side panels 34*a*, 34*b*, 34*c*, 34*d* and the base 36. The side panels 34*a*, 34*b*, 34*c*, 34*d* and the base 36 are preferably each constructed from the robust and semi-rigid material. They are preferably together adapted to contain about one cubic yard of soil or another bulk garden product 20.

The tarpaulin top section 60 is preferably adapted to selectively close the FIBC 30 and to protect the soil 20 inside from the outside elements (e.g., wind, rain, snow). The top section 60 preferably includes the top tie member 62 to selectively close it.

The FIBC device, system, and method according to the invention preferably enable users to tie down the top section 60 of the bag 30 at each corner 46, thus preferably enabling increased and better access into the inside portion 38 of the main bag section 32 of the FIBC device 30 that contains the bulk garden products 20.

The FIBC device, system, and method preferably implement upper or top sets (i.e., set 40*a*,42*a*, set 40*b*,42*b*, set 40*c*,42*c*, and set 40*d*,42*d*) and lower or middle sets (i.e., set 50*a*,52*a*, set 50*b*,52*b*, set 50*c*,52*c*, and set 50*d*,52*d*) of main section ties or bag cords 40*a*, 40*b*, 40*c*, 40*d*, 50*a*, 50*b*, 50*c*, 50*d* and corresponding loop 42*a*, 42*b*, 42*c*, 42*d*, 52*a*, 52*b*, 52*c*, 52*d*. The ties 40*a*, 40*b*, 40*c*, 40*d*, 50*a*, 50*b*, 50*c*, 50*d* are preferably secured to the inside 38, and the loops 42*a*, 42*b*, 42*c*, 42*d*, 52*a*, 52*b*, 52*c*, 52*d* are preferably secured to the outside 44, of the bag's main section 32.

The upper sets of ties and loops (i.e., set 40*a*,42*a*, set 40*b*,42*b*, set 40*c*,42*c*, and set 40*d*,42*d*) are preferably provided substantially adjacent to a top portion 48 of the bag's main section 32 (e.g., below the tarpaulin top section 60). The upper sets 40*a*,42*a*, 40*b*,42*b*, 40*c*,42*c*, 40*d*,42*d* preferably enable and facilitate the bag's tarpaulin top section 60 to be tucked and rolled down, and securely tied out of the way, by a user 26 when accessing the bulk garden products 20 inside the main section 32 of the FIBC device 30.

The lower sets of ties and loops (i.e., set 50*a*,52*a*, set 50*b*,52*b*, set 50*c*,52*c*, and set 50*d*,52*d*) are preferably provided (below the upper sets 40*a*,42*a*, 40*b*,42*b*, 40*c*,42*c*, 40*d*,42*d*) about half-way down the bag 30, substantially adjacent to a middle portion 54 of the bag's main section 32. The lower sets 50*a*,52*a*, 50*b*,52*b*, 50*c*,52*c*, 50*d*,52*d* preferably enable and facilitate the tarpaulin top section 60 to be tucked and rolled down, and securely tied out of the way, by the user 26 after the bag 30 has been partially emptied.

These bags 30 effectively protect the bulk products 20 contained within from the elements and enable these bulk products 20 to be easily moved around a yard, loaded in groups onto trucks 28, and delivered to others. The devices, systems, and methods according to the invention preferably utilize a combination of ties and loops in convenient locations on such bags 30 to allow users 26 to secure an otherwise loose top section 60 of the bag 30 and keep it out of the way while accessing the bulk products 20 contained within. As discussed above and elsewhere herein, the bags 30 are preferably provided with upper and lower sets of ties and corresponding loops according to the invention.

The upper ties 40*a*, 40*b*, 40*c*, 40*d* are preferably located on the inside 38 of the bag 30, one at each of the four corners 46. Corresponding upper loops 42*a*, 42*b*, 42*c*, 42*d*, at about the same vertical position as the upper ties 40*a*, 40*b*, 40*c*, 40*d*, are preferably located on the outside 44 of the bag 30. The upper ties 40*a*, 40*b*, 40*c*, 40*d* can preferably easily reach their corresponding upper loops 42*a*, 42*b*, 42*c*, 42*d*. Thus, users 26 can preferably secure the top 60 of the bag 30, when the bag 30 is open and rolled down to a desired level/position.

The upper sets of ties and loops 40*a*,42*a*, 40*b*,42*b*, 40*c*, 42*c*, 40*d*,42*d* are preferably positioned in such a way that, when used to secure the bag's top section 60, they enable easy access to the products 20 within the bag 30 after it has first been opened and may be substantially full.

The lower sets of ties and loops 50*a*,52*a*, 50*b*,52*b*, 50*c*, 52*c*, 50*d*,52*d* are preferably positioned roughly about half-way down the bag 30. After the bag 30 has been partially emptied, the user 26 may selectively untie the upper sets of loops and ties 40*a*,42*a*, 40*b*,42*b*, 40*c*,42*c*, 40*d*,42*d*, and tuck or roll down the bag 30 to a lower level/position substantially adjacent to the lower sets of ties and loops 50*a*,52*a*, 50*b*,52*b*, 50*c*,52*c*, 50*d*,52*d*. Preferably, the lower sets of ties and loops 50*a*,52*a*, 50*b*,52*b*, 50*c*,52*c*, 50*d*,52*d* may then be selectively used to secure even more of the bag 30, including the upper portion 48, which otherwise might have remained loose and as an obstruction in the user's way while trying to empty (or fill) the bag 30.

Preferably, at any point during use of FIBC device 30, users 26 may selectively untie the ties from their corresponding loops and secure the tarpaulin top 60 to protect the internal products 20 from the elements. This may preferably enable or help users 26 not only to easily access the bag's interior 38 or the products 20, but also to work with the bag 30 and the products 20 at their own pace—preferably without or with less worry about potential contamination or unwanted moisture, e.g., while not in use or if the users 26 may be unable to immediately empty the bag 30.

Method/Process Steps:

The device 30 is preferably used with the following steps (among others):

a.) The user 26 preferably receives a FIBC device or bag 30, and opens the initial top tie member 62 that had previously secured the tarpaulin top section 60 in a closed configuration.

b.) The user 26 preferably tucks or rolls down the bag's loose top section 60 towards the bag's main section 32.

c.) The user 26 preferably reaches inside the bag 30 at a first one of its four corners 46. The user 26 preferably locates two tie strings 40*a* that are provided inside the bag 30 adjacent to the first corner 46. (Two tie strings 40*a*, 40*b*, 40*c*, 40*d* are preferably provided and located adjacent to each such corner 46 in the upper sets of ties and loops. And, two more tie strings 50*a*, 50*b*, 50*c*, 50*d* are preferably provided and located adjacent to each such corner 46 in the lower sets.)

d.) The user 26 preferably pulls at least one of these two tie strings 40*a* and locates the corresponding loop 42*b* on the outside 44 of the bag 30 at the first corner 46.

e.) The user 26 preferably inserts one of the strings 40*a* through its corresponding loop 42*b*, pulls it tight, and uses the other tie string 40*a* to create a knot and secure that corner 46 of the bag's open top 60.

f.) The user repeats steps c.) to e.) above for each of the bag's remaining three other corners 46, preferably until the entire loose top 60 of the bag 30 has been secured, and preferably creating a wide open top to the bag 30. Preferably, the user 26*b* can then easily access the product 20 contained within.

g.) After perhaps about half of the product 20 has been removed from the bag 30, the user 26 may selectively untie each of the four ties and loops in the upper sets 40*a*,42*a*, 40*b*,42*b*, 40*c*,42*c*, 40*d*,42*d*.

h.) The user 26 preferably further tucks and rolls down the top section 60, together with an upper portion 48 of the bag's main section 32, and repeats steps c.) to e.) above with the tie strings 50*a*, 50*b*, 50*c*, 50*d* and corresponding loops 52*a*, 52*b*, 52*c*, 52*d* adjacent to each corner 46 in the lower sets that are located about half-way down the bag 30. And/or, i.) Preferably, at any time during the process, the user 26 may selectively untie all ties from their corresponding loops, unfurl the top section 60 of the bag 30, and secure the tarpaulin top section 60 using the top tie member 62 to protect the internal products 20 from the elements.

As discussed above, according to the invention, the device, system, and method utilizes upper sets 40*a*,42*a*, 40*b*,42*b*, 40*c*,42*c*, 40*d*,42*d* and lower sets 50*a*,52*a*, 50*b*,52*b*, 50*c*,52*c*, 50*d*,52*d* of ties and corresponding loops located at each of the four corners 46 of the FIBC device or bag 30 (e.g., a total of eight ties with corresponding loops). These upper sets 40*a*,42*a*, 40*b*,42*b*, 40*c*,42*c*, 40*d*,42*d* and lower sets 50*a*,52*a*, 50*b*,52*b*, 50*c*,52*c*, 50*d*,52*d* of ties and their corresponding loops enable or help the top section 60/upper portion 48 of the bag 30 to be secured, in an open and easily accessible configuration, at different stages of the bag emptying and/or filling process.

Being able to secure an otherwise loose tarpaulin top section 60 of the FIBC device or bag 30 at any point, without use of additional tools, represents an entirely new and inventive step over the prior art.

In use, the device, system, and method according to preferred embodiments of the invention preferably enable or afford much easier access into the bag's interior 38, and any products 20 contained therein, at all points during the bag emptying process (or filling process). Use of the invention preferably enables or helps users 26 to avoid, and keeps them from being impeded or obstructed by, an otherwise loose tarpaulin top section 60 when trying to empty (or fill) their bag 30. Elderly users and users with different physical abilities can preferably use the easy-empty features of the present invention to make emptying (or filling) the bag 30 significantly easier. Use of the device, system, and method according to the invention preferably also helps users 26 to keep the associated FIBCs 30 in better condition than any prior art FIBCs. (Prior art FIBCs sometimes may have been cut by users in order to better access the contained products, even if that meant that such bags could not be reused.) The present invention helps to reduce damage that otherwise might be inflicted to bags during use, and it preferably enables or facilitates the more frequent return and re-use of FIBC devices provided according to the invention.

The invention is contemplated for use in association with the applicant's BigYellowBag™ garden product delivery system, for example, to inventory and distribute a variety of high quality garden products 20 directly to homeowners and/or to afford increased advantageous utilities in association with same. The invention, however, is not so limited. For example, FIBCs may be used in a variety of other industries and/or applications, or to contain soil for use in other contexts, or to contain or load bulk or other products and things (other than bulk garden products). The BigYellowBag™ bulk bag design may have different iterations, using different materials and dimensions. Other embodiments, which fall within the scope of the invention, may be provided.

The foregoing description has been presented for the purpose of illustration and is not intended to be exhaustive or to limit the invention to the precise form disclosed.

Naturally, in view of the teachings and disclosures herein, persons having ordinary skill in the art may appreciate that alternate designs and/or embodiments of the invention may be possible (e.g., with substitution of one or more components for others, with alternate configurations of components, etc). Although some of the components, relations, configurations and/or steps according to the invention are not specifically referenced in association with one another, they may be used, and/or adapted for use, in association therewith. For example, features may be discussed herein in the context of the device, which clearly could be recast as steps of a method and/or as the interworking of a system. All of the aforementioned and various other features, steps, interworkings, structures, configurations, relationships, utilities, and/or the like (any of which may be depicted and/or based hereon) may be, but are not necessarily, incorporated into and/or achieved by the invention. Any one or more of the aforementioned features, steps, interworkings, structures, configurations, relationships, utilities and the like may be implemented in and/or by the invention, on their own, and/or without reference, regard or likewise implementation of any of the other aforementioned features, steps, interworkings, structures, configurations, relationships, utilities and the like, in various permutations and combinations, as will be readily apparent to those skilled in the art, without departing from the pith, marrow, and spirit of the disclosed invention.

Other modifications and alterations may be used in the design, manufacture, and/or implementation of other embodiments according to the present invention without departing from the spirit and scope of the invention, which is limited only by the claims hereof.

The invention claimed is:

1. A flexible container for containing bulk garden products, with the flexible container comprising:

(a) a main bag section that is constructed from a robust semi-rigid material, wherein the main bag section has a base and one or more side portions that securely engage the base, wherein each of the side portions has an upper portion, wherein the base and the side portions are together shaped to define an inside portion for containing the bulk garden products, and wherein the side portions define at least one outside wall;

(b) an elongate top section that is constructed from a tarpaulin material, wherein the elongate top section securely engages the upper portion of the main bag section, wherein the elongate top section is shaped to define an opening, and wherein the elongate top section is adapted to be selectively moved between an open configuration that enables access through the opening into the inside portion of the main bag section, and a closed configuration that blocks the opening and protects the bulk garden products in the inside portion of the main bag section against outside elements; and (c) four or more sets of bag tie members securely engaging the main bag section, wherein each of the sets is spaced apart from each other at substantially regular intervals about the side portions of the main bag section, and wherein the sets of said bag tie members are adapted to selectively gather and tie down the elongate top section at substantially regular intervals all the way around the opening in the open configuration and, thus, to enable clear and ready access into the inside portion of the main bag section containing the bulk garden products.

2. The flexible container according to claim 1, wherein each of the sets of said bag tie members comprises an outer tie member and a corresponding inner tie member adapted to be selectively and securely tied to said outer tie member; wherein said outer tie member is secured to the outside wall; and wherein the corresponding inner tie member is secured to the inside portion of the main bag section.

3. The flexible container according to claim 2, wherein the outer tie member comprises a corresponding loop member and the corresponding inner tie member comprises a bag cord member; and wherein each said bag cord member is adapted to be selectively and securely tied to said corresponding loop member.

4. The flexible container according to claim 1, wherein each of the side portions has a middle portion that is located about midway between the upper portion and the base; and wherein the four or more sets of said bag tie members comprise: (a) four or more top sets of said bag tie members that securely engage the upper portion of the main bag section, wherein the top sets of said bag tie members are adapted to selectively gather and tie down the elongate top section as aforesaid; and (b) four or more middle sets of said bag tie members that securely engage the middle portion of the main bag section, wherein the middle sets of said bag tie members are adapted to, after about half of the bulk garden products have been emptied from the main bag section, selectively gather and tie down the elongate top section as aforesaid and, also, selectively gather and tie down the upper portion of the main bag section when the elongate top section is in the open configuration and, thus, to enable continued clear and ready access to any said bulk garden products that then remain in the inside portion of the main bag section.

5. The flexible container according to claim 1, wherein the side portions comprise four side panels defining four corners, one each between adjacent ones of the four side panels, such that the inside portion is substantially rectangular.

6. The flexible container according to claim 5, wherein at least one of said sets of said bag tie members securely engages the main bag section adjacent to each of said four corners.

7. The flexible container according to claim 1, wherein the elongate top section is provided with one or more top tie members to selectively secure the elongate top section in the closed configuration.

8. The flexible container according to claim 7, wherein the top tie members comprise a top loop member and a top cord member that is adapted to be selectively and securely tied to said top loop member to secure the elongate top section in the closed configuration.

9. The flexible container according to claim 1 that is adapted to contain about one cubic yard of the bulk garden products.

10. The flexible container according to claim 1, wherein the outside wall presents advertising media.

11. The flexible container according to claim 1 that is adapted for use with a flatbed truck and with forks of a forklift; wherein the flexible container further comprises two or more lifting hoops securely engaging the main bag section, such that the flexible container containing said bulk garden products can be selectively carried and suspended, by the lifting hoops, on the forks of the forklift while being loaded onto and off from the flatbed truck.

12. The flexible container according to claim 1 that is adapted for use with a flatbed truck; wherein the flexible container is sized and shaped to contain about one cubic yard of the bulk garden products, and such that three of said flexible containers can together fit across the width of the flatbed truck.

* * * * *